US007645129B2

(12) United States Patent
Kim et al.

(10) Patent No.: US 7,645,129 B2
(45) Date of Patent: Jan. 12, 2010

(54) OIL PUMP FOR A SCROLL COMPRESSOR

(75) Inventors: Myung Kyun Kim, Boocheon-si (KR); Byeong Chul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 11/637,219

(22) Filed: Dec. 12, 2006

(65) Prior Publication Data

US 2007/0183916 A1 Aug. 9, 2007

(30) Foreign Application Priority Data

Dec. 12, 2005 (KR) ..... 10-2005-0121530

(51) Int. Cl.
*F04C 2/00* (2006.01)
*F04C 29/00* (2006.01)

(52) U.S. Cl. ..... 418/47; 418/55.1; 418/55.6; 418/88; 418/89

(58) Field of Classification Search ..... 418/55.1–55.6, 418/57, 46, 47, 89, 94, 97–100, 102, 270, 418/DIG. 1, 88; 184/6.16–6.18
See application file for complete search history.

(56) References Cited

U.S. PATENT DOCUMENTS 3,887,035 A * 6/1975 Hannibal ..... 184/6.16
4,325,679 A 4/1982 Smith
5,775,120 A 7/1998 Inazuka et al.
5,775,123 A 7/1998 Wakayama et al.
5,947,373 A 9/1999 Saito et al.
6,182,460 B1 2/2001 Hernandez et al.
6,287,099 B1 9/2001 Chang, II et al.
6,374,492 B1 4/2002 Myung et al.
6,412,298 B2 7/2002 Kang et al.
6,588,228 B2 7/2003 Choi
6,659,735 B2 12/2003 Kim
6,685,441 B2 2/2004 Nam
6,695,600 B2 2/2004 Koo et al.
6,772,601 B1 8/2004 Davis et al.
6,868,681 B2 3/2005 Woo et al.
6,951,628 B2 10/2005 Eidam et al.
6,955,064 B2 10/2005 Lee et al.

(Continued)

FOREIGN PATENT DOCUMENTS

JP 06235387 A * 8/1994

(Continued)

OTHER PUBLICATIONS

Chinese Office Action dated Aug. 21, 2009 (full Chinese text and full English translation).

*Primary Examiner*—Theresa Trieu
(74) *Attorney, Agent, or Firm*—KED & Associates, LLP

(57) ABSTRACT

An oil pump for a compressor includes a driving shaft having an oil passage, a gear driving unit coupled to the drive shaft, a pump body having a driving shaft insertion groove, a friction reducing member assembled on the driving shaft insertion groove to reduce friction between the driving shaft and pump body, and a a gear unit coupled to the pump body and rotating with rotation of the driving shaft. The pump may further include a pump cover coupled to the pump body and having an intake for inhaling oil.

20 Claims, 12 Drawing Sheets

U.S. PATENT DOCUMENTS 6,962,058 B2 11/2005 Kim et al.
7,032,404 B2 4/2006 Kim et al.
7,036,331 B2 5/2006 Kim
7,055,338 B2 6/2006 Ergarac et al.
7,082,776 B2 8/2006 Shin
7,114,345 B2 10/2006 Kim et al.
7,121,106 B2 10/2006 Jung et al.
2007/0122303 A1* 5/2007 Kim et al. ..... 418/55.6

FOREIGN PATENT DOCUMENTS

JP 09151884 A * 6/1997
JP 2004144103 A * 5/2004

* cited by examiner

OIL PUMP FOR A SCROLL COMPRESSOR

BACKGROUND

1. Field

One or more embodiments described herein relate to supplying oil for lubricating moving parts.

2. Background

A compressor converts mechanical energy into a compressive force. One type of compressor known as a scroll compressor is used in air conditioners and freezers for lubricating moving parts and/or for controlling the flow of refrigerant, as well as for other purposes.

Scroll compressors are often equipped with a pump for pumping oil and refrigerant inside of one or more oil passages. The oil is used to lubricate moving parts inside the machine and the refrigerant is used for cooling purposes. During operation, frictional forces that are not offset by lubrication generate heat which evaporates refrigerant as it flows within the oil passages. Also, bubbles that collect in these passages cause congestion. All of these effects degrade performance and may serve to reduce the useful life of the machine.

BRIEF DESCRIPTION OF THE DRAWINGS

The embodiments will be described in detail with reference to the following drawings, in which like reference numerals refer to like elements.

DETAILED DESCRIPTION

Generally speaking, there are two types of scroll compressors: low-pressure-type scroll compressors and high-pressure type scroll compressors. They differ in terms of whether a casing of the scroll compressor is filled with a suction gas or a discharge gas.

Some low-pressure-type scroll compressors are formed from a casing, drive motor, drive shaft, an upper frame, and an intake pipe. The drive motor is provided inside the casing and includes a rotor and a stator. The drive shaft is rotated by the motor and has an eccentric portion on the upper frame and an oil passage therein. The upper frame is inserted on an upper side of the drive shaft, and the intake pipe is provided through which fluid is inhaled from an external source.

This type of scroll compressor further includes an orbiting scroll, a scroll compression unit, and a discharge pipe. The orbiting scroll is placed on an upper side of the upper frame and operates to compress refrigerant inhaled through the intake pipe by orbital movement. The scroll compression unit includes a fixed scroll interlocked with the orbiting scroll and is fixed on the upper side of the upper frame. The discharge pipe operates to discharge refrigerant compressed in the scroll compression unit.

The scroll compressor further includes a pump which pumps oil stored in an oil storage reservoir at a lower side of the scroll compressor. The oil pump includes a frame, a roller assembled on the frame which rotates with the driving shaft, and a cover assembled on the lower side of the frame.

In operation, when low-pressured refrigerant is inhaled through the intake pipe, a portion of the refrigerant flows into the scroll compression unit and the remaining portion flows into the lower part of the compressor. The portion that flows into the scroll compression unit is discharged at higher pressure through the discharge pipe.

During the compression process, refrigerant and oil in the storage reservoir are pumped by the roller through an oil passage. The refrigerant and oil are then supplied to a friction part to be lubricated. However, while the oil pump is operating, refrigerant flowing inside the passage evaporates by friction heat produced inside of the pump. This heat is generated, for example, as a result of the motor rotating the drive shaft, during which time instant changes in pressure occur. Furthermore, bubbles are produced in the oil passage as the refrigerant is evaporated. These bubbles collect to congest the passage. As a result, oil cannot flow easily through the oil passage and therefore the friction part is not lubricated and wears down greatly by abrasive forces. Moreover, the capacity and reliability of the compressor are decreased.

In addition to these effects, the oil passage may be congested by foreign elements in the refrigerant and oil. These foreign elements hamper the ability of the oil pump to performing its pumping operation.

Figure 1:
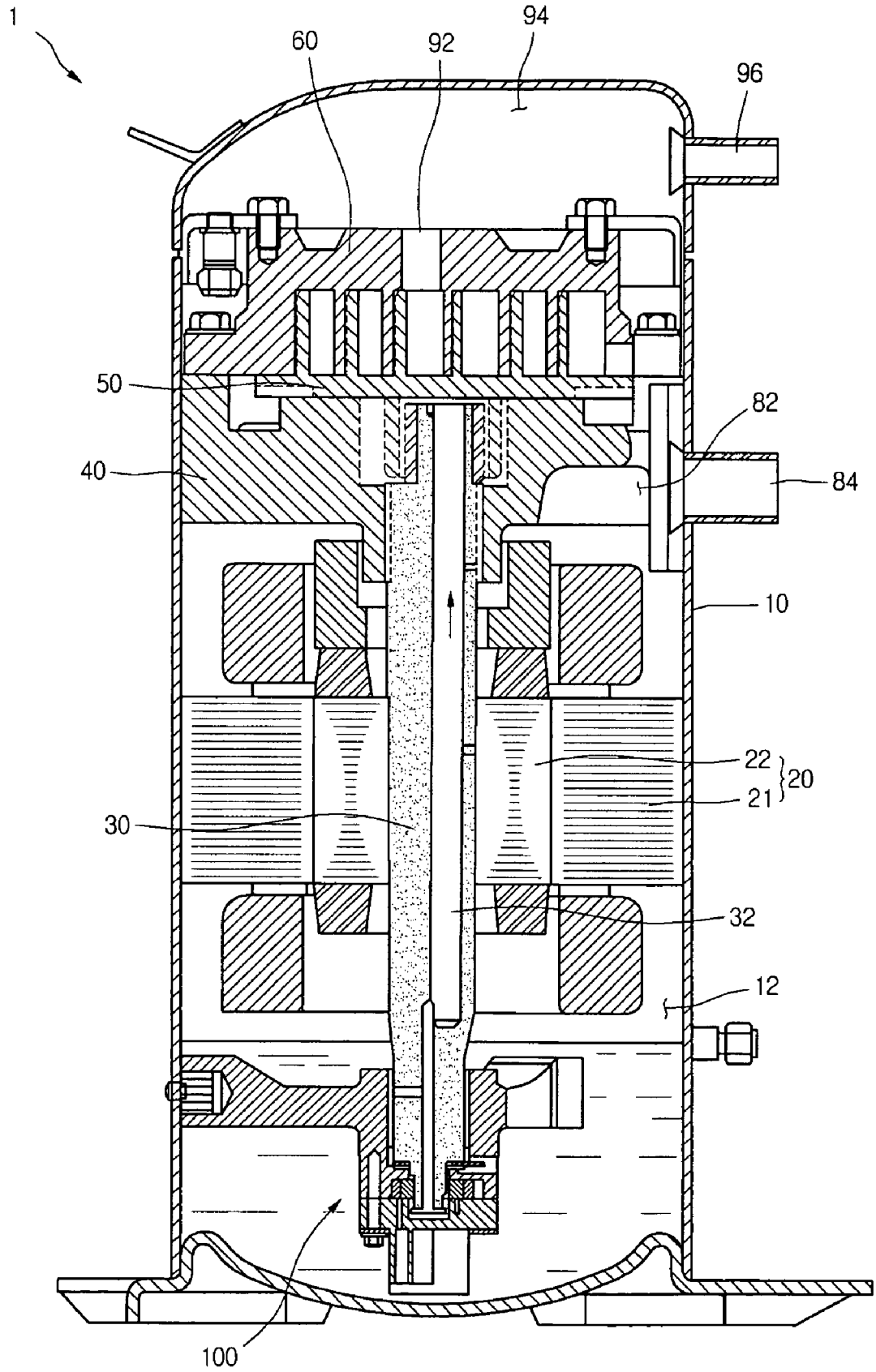
FIG. 1 is a diagram showing a cross-sectional view of one embodiment of a scroll compressor.

FIG. 1 shows, in cross section, one embodiment of a scroll compressor. The scroll compressor 1 includes a casing 10, a drive unit for generating a rotary force, an inhalation unit for inhaling fluid from an outside source, a scroll compression unit for compressing fluid inhaled from the inhalation unit, a discharging unit for discharging high-pressured fluid compressed in the scroll compressing unit, and an oil pump 100 for pumping oil stored in an oil storage reservoir 12 at a lower side of the casing.

The driving unit includes a driving motor 20 having a stator 21 fixed to an inner side of the casing, a rotor 22 at an inner side of the stator, and a driving shaft 30 which rotates at a center of the driving motor.

The inhalation unit includes an intake pipe 84 at one side of the outer circumference of the casing and an inhalation chamber 82 connected to the intake pipe for storing inhaled refrigerant.

The scroll compression unit comprises an upper frame 40, an orbiting scroll 50, and a fixed scroll 60. The upper frame supports and is fixed on an upper side of the driving shaft 30. The orbiting scroll is located on the upper side of the upper frame for compressing refrigerant inhaled through intake pipe 84. And, the fixed scroll is coupled with the orbiting scroll and is fixed on the upper side of the upper frame.

The discharge unit comprises a discharge port 92, a discharge chamber 94, and a discharge pipe. The discharge port is formed on the middle of fixed scroll 60 for discharging compressed refrigerant and oil. The discharge chamber 94 is connected to the discharge port 92 and is formed on the upper side of the casing 10. And, the discharge pipe 96 formed on a side of the discharge chamber 94.

The oil pump 100 is placed on a lower side of an interior of the casing and is connected with driving shaft 30. The oil stored in the oil storage reservoir 12 is pumped by rotation of the driving shaft.

Operation of the scroll compressor will now be discussed. First, refrigerant is inhaled through intake pipe 84. A portion of the inhaled refrigerant passes the inhalation chamber 82 and flows into the scroll compression unit. The remaining portion of the refrigerant flows into the oil storage reservoir where it is stored.

The refrigerant that flows into the scroll compression unit is compressed at a predetermined (e.g., high) pressure by orbiting of orbiting scroll 50. The compressed refrigerant accumulates in the middle of the scroll compression unit and then is transferred to discharge chamber 94 through discharge port 92. Finally, the refrigerant in chamber 94 is discharged out of the scroll compressor through discharge pipe 96.

During compression, the refrigerant and oil stored in oil storage reservoir 12 is pumped by the oil pump to an upper side as a result of rotation of driving shaft 30. The pumped oil flows along an inner part of shaft 30 until it is supplied to the friction part that is to be lubricated.

Figure 2:
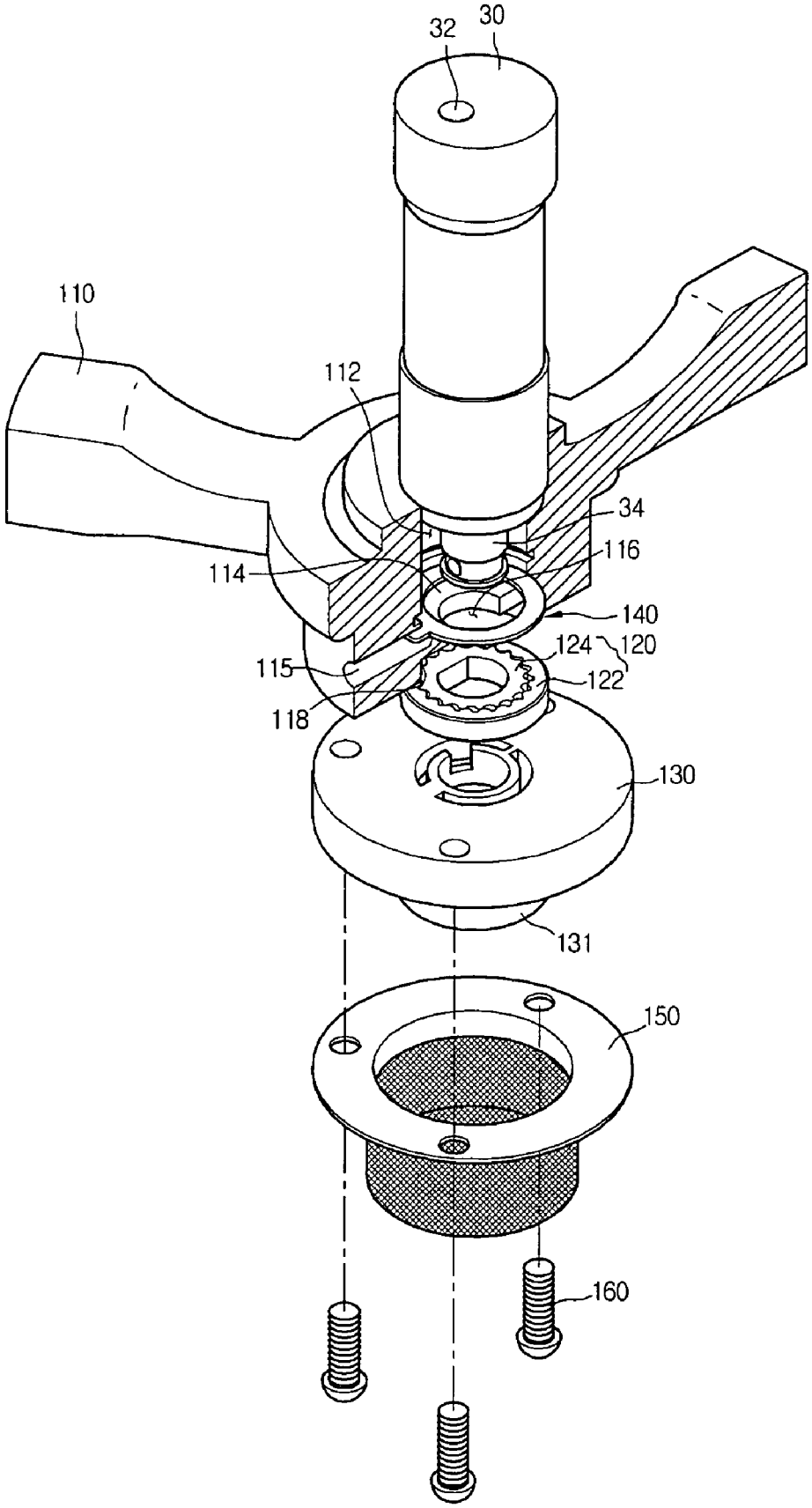
FIG. 2 is a diagram showing a perspective view of an oil pump that may be included in the scroll compressor of FIG. 1.

FIG. 2 shows one embodiment of an oil pump that may be used in the scroll compressor of FIG. 1. The oil pump includes a pump body 110, a gear unit 120, a pump cover 130, and a filter member 150. The pump body is adapted to receive driving shaft 30 at a central location. The gear unit 120 is inserted on the lower side of the pump body and rotates with the driving shaft. The pump cover 130 is assembled on the lower side of the pump body, and the filter member 150 filters any foreign elements that may be included in the refrigerant and oil as it is pumped from reservoir 12.

The driving shaft 30 has a predetermined diameter and length and includes the oil passage through which the pumped oil flows.

The gear driving unit 34 may be formed in one body and is capable of rotating gear unit 120 as assembled.

The pump body 110 may be welded to an inner circumferential surface of the casing. A driving shaft insertion groove 112, into which the driving shaft 30 is inserted, is formed and depressed to a predetermined depth on the pump body 110.

A plate location part 114, where a friction reducing plate 140 is placed, is located on the lower part of the driving shaft insertion groove 112. The friction reducing plate 140 reduces or minimizes friction heat, which causes evaporation of the liquid refrigerant. The friction reducing plate, therefore, reduces the friction between the driving shaft 30 and the pump body 110 during the rotation of the driving shaft 30.

In addition, a driving unit penetrating hole 116, located where the gear driving unit 34 is coupled through, is formed on the lower part of the driving shaft insertion groove 112. A gear insertion groove 118, where the gear unit 120 is inserted, is formed and depressed to the upper side on the lower part of the pump body 110.

The gear unit 120 causes the pumping process to progress, and comprises outer gear 122 and inner gear 124 inserted into the outer gear. The gear driving unit 34 is located on the inner gear and the inner and outer gears are rotated by driving shaft 30.

The pump cover 130 is assembled on the lower side of the pump body 110. The pump cover allows the refrigerant and oil in the reservoir 12 to flow into the gear unit 120. The oil flowing through the gear unit 120 then flows into the driving shaft 30.

The filter member 150 is assembled on the lower side of the pump cover 130 and operates to filter foreign elements from the refrigerant and oil flowing into pump cover 130.

The pumping operation of the oil will now be described. First, oil and refrigerant flow through pump cover 130 as coupled to inner gear 124 and outer gear 122. Foreign elements in the oil and refrigerant are removed by filter member 150. The outer gear 122 rotates with inner gear 124 (assembled with the gear driving unit 34) when driving shaft 30 rotates. Friction reducing plate 140 prevents direct friction of the lower part of the driving shaft 30 and pump body 110.

The oil and refrigerant (which is caused to flow by rotation of the gear unit 120), then, flows into the oil passage after it is discharged from pump cover 130. The oil and refrigerant flow through the oil passage to the upper side, where the oil is supplied to the friction part.

Figure 3:
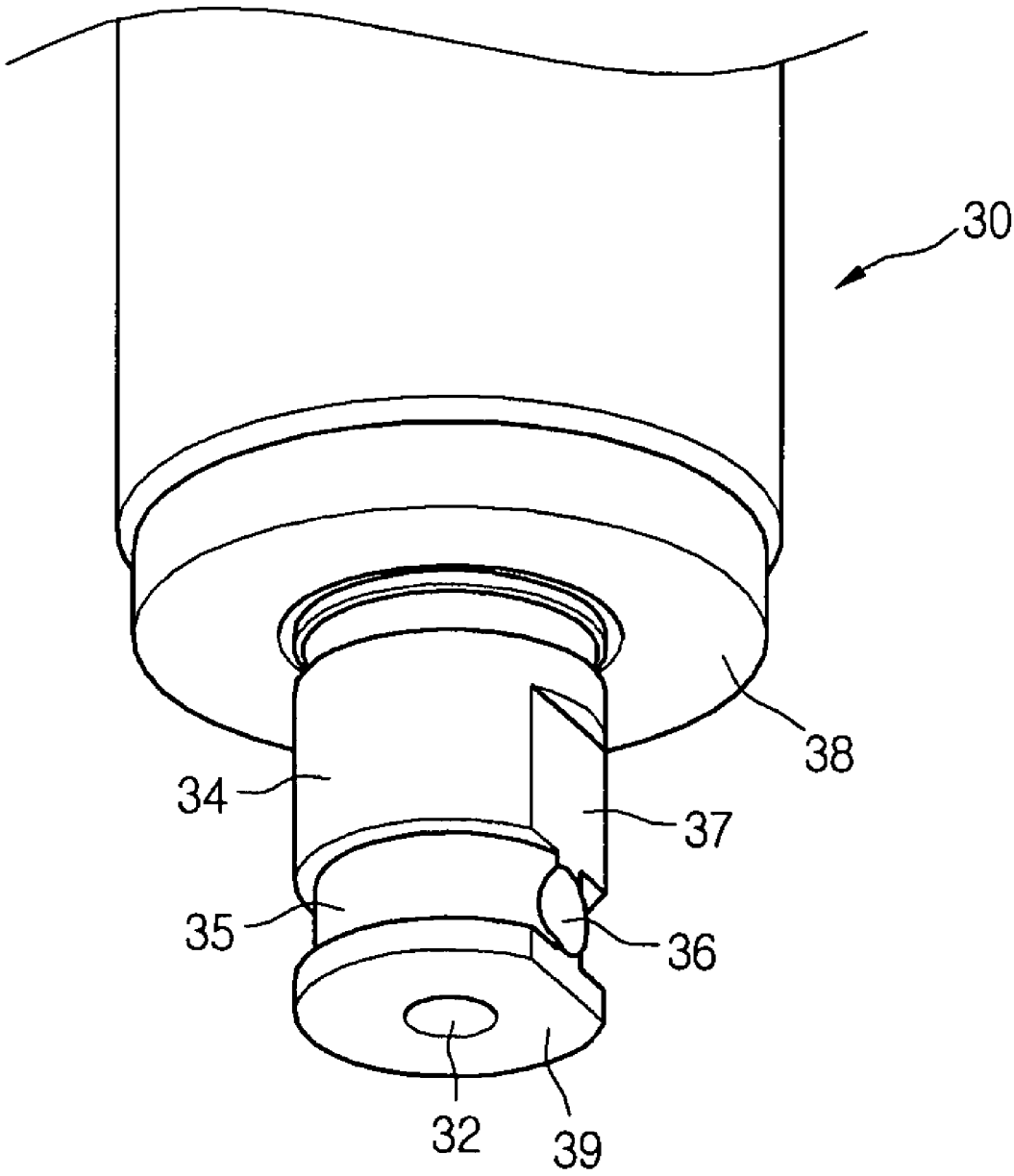
FIG. 3 is a diagram showing one portion of a driving shaft that may be included in or with the oil pump of FIG. 2.

FIG. 3 shows one possible configuration of the lower part of the driving shaft. As shown, a gear driving unit 34 for rotating inner gear 124 is formed, preferably in one body, on the lower side of the shaft. The outer diameter of the gear driving unit is smaller than the outer diameter of the shaft. An oil passage 32 through which the pumped oil passes is formed in the driving shaft.

On the outer circumference of the gear driving unit 34, a guide groove 35 is formed to allow oil to flow smoothly. A horizontal oil passage 36 into which the oil flows is formed in guide groove 35. Vertical oil passage 32 is connected to horizontal oil passage 36, which is formed to be perpendicular to driving shaft 30.

The oil ascends perpendicularly through passage 32 after it flows in the horizontal direction through oil passage 36. A plane driving surface 37 for inner gear 124 is formed on one side of the gear driving unit 34. The gear driving unit is assembled on inner gear 124 and has a direction based on driving surface 37.

The drive shaft 30 has a first lower surface 38 and a second lower surface 39, which is the lower surface of the gear driving unit 34. The first lower part 38 makes contact with the friction reducing plate 140. As a result, the first lower part 38 and the pump body 110 are prevented from rubbing together during rotation of the driving shaft.

Figure 4:
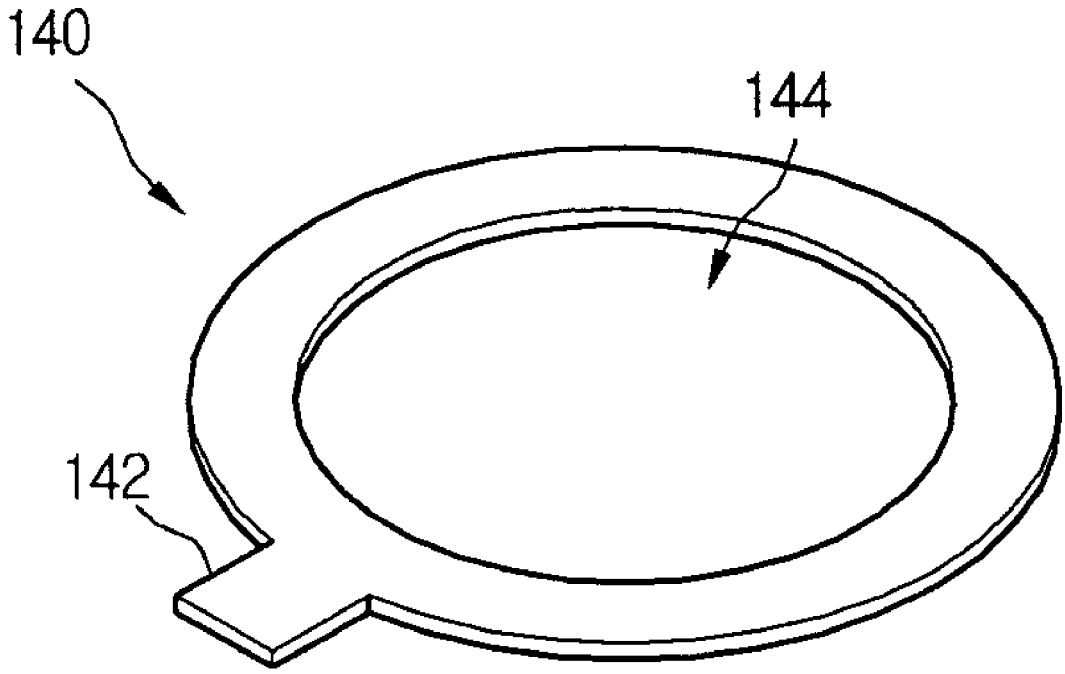
FIG. 4 is a diagram showing one type of friction reducing plate that may be included in or with the oil pump of FIG. 2.

FIG. 4 shows one possible configuration of friction reducing plate 140. As shown, the friction reducing plate may be ring-shaped and its profile may be rectangular. The friction reducing plate is adapted for insertion into driving shaft insertion groove 112. A drive unit penetrating hole 144, where the gear driving unit 34 passes through, is formed at the center of the friction reducing plate.

Furthermore, a fixing unit 142, for fixing friction reducing plate 140 on the pump body when it is placed on plate location part 114, protrudes from one direction. In this part, a fixing hole 115 for inserting the fixing unit is formed on the pump body.

The outer diameter of the friction reducing plate 140 is smaller than the inner diameter of the driving shaft insertion groove 112 to be inserted into the driving shaft insertion groove 112. Preferably, the friction reducing plate 140 is elastic. Therefore, it is possible that the friction reducing plate 140 may be inserted into the driving shaft inserting groove 112 based on a preferred size and quality, even though it has protruding fixing portion 142.

The driving shaft 30 and pump body 110 are prevented from directly rubbing against each other as a result of friction reducing plate 140 being placed on the driving shaft inserting groove 112. This reduces the generation of friction heat, which otherwise may cause evaporation of the liquid refrigerant.

Figure 5:
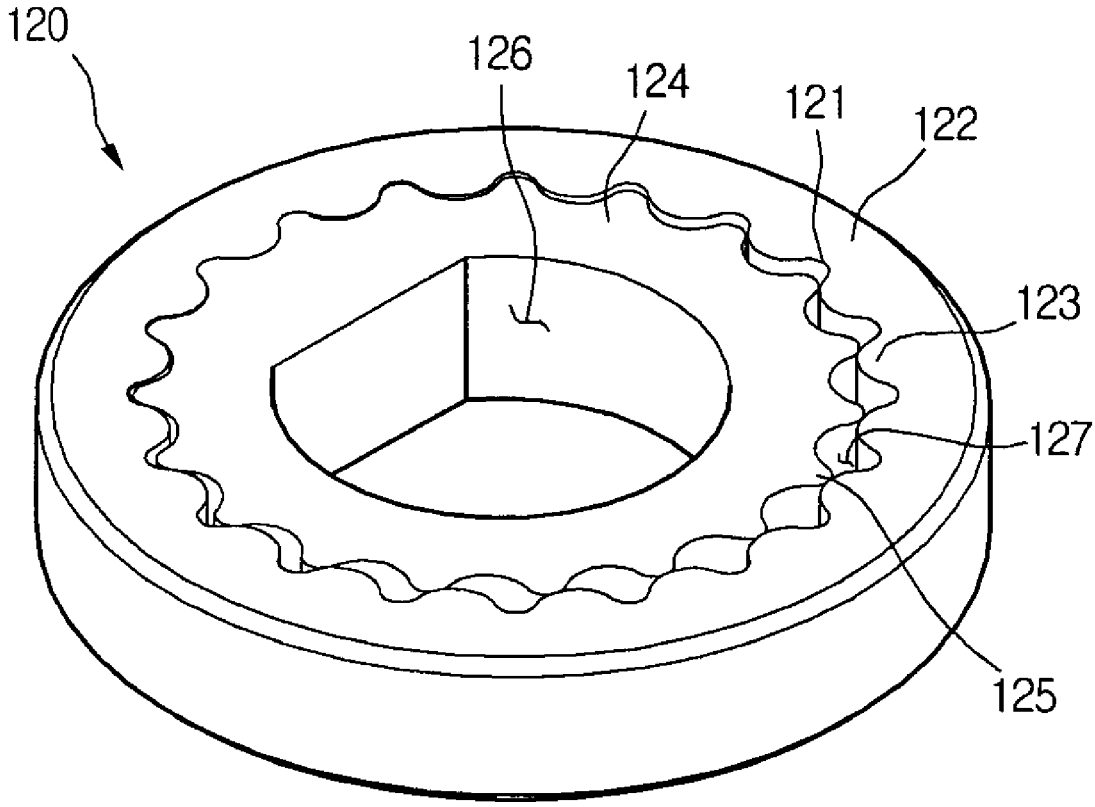
FIG. 5 is a diagram showing a perspective view of a gear unit that may be included in or with the oil pump of FIG. 2.

FIG. 5 shows one embodiment of the gear unit. The gear unit includes an inner gear 124 having gear teeth 125 on an outer circumferential surface and an outer gear 122 having gear teeth on an inner circumferential surface where the inner gear is inserted. An inner gear insertion hole 121, where the inner gear 124 is inserted, is formed on the outer gear 122. Gear teeth 123 are formed on the inner circumferential surface of the inner gear insertion hole 121.

A drive unit insertion hole 126 is coupled to the gear driving unit 34 and is formed as a counterpart of the gear driving unit 34. More particularly, the diameter of inner gear insertion hole 121 is larger than the diameter of the inner gear 124. When the inner gear is inserted into the inner gear insertion hole, the inner and outer gears are not fitted completely and therefore one or more chambers 127 are formed. Further, the refrigerant and oil inhaled through pump cover 130 flow into chambers 127.

When the gear unit rotates, the refrigerant and oil flow into chamber 127. The refrigerant and oil in the chambers are then pumped by the rotation pressure. As the chambers are formed, the supplying and pumping of the oil stably progresses. As a result, an irregular supply of oil caused by changes in inhalation pressure and evaporation of the refrigerant is prevented.

Figure 6:
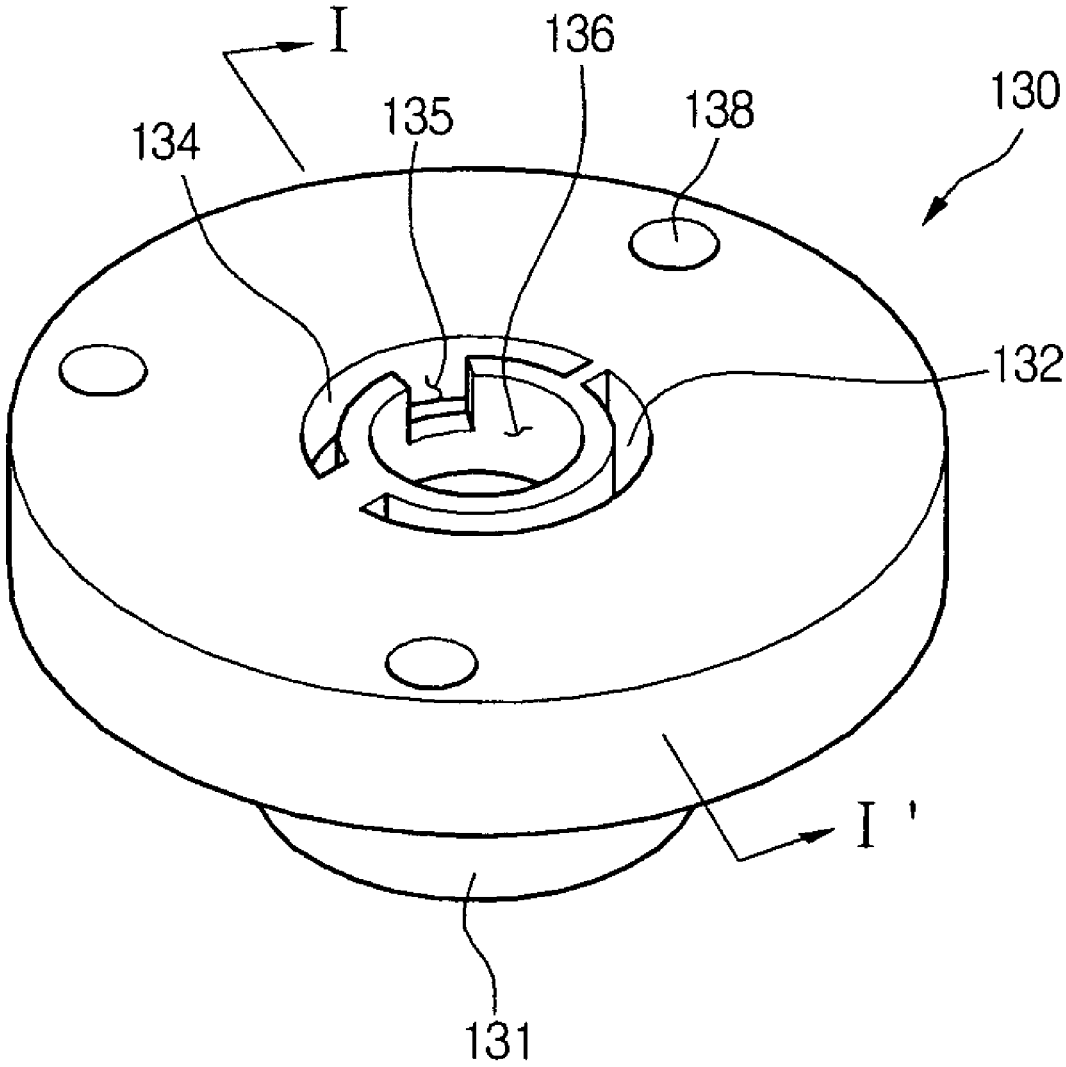
FIG. 6 is a diagram showing a perspective view of a pump cover that may be included in or with the oil pump of FIG. 2.
Figure 7:
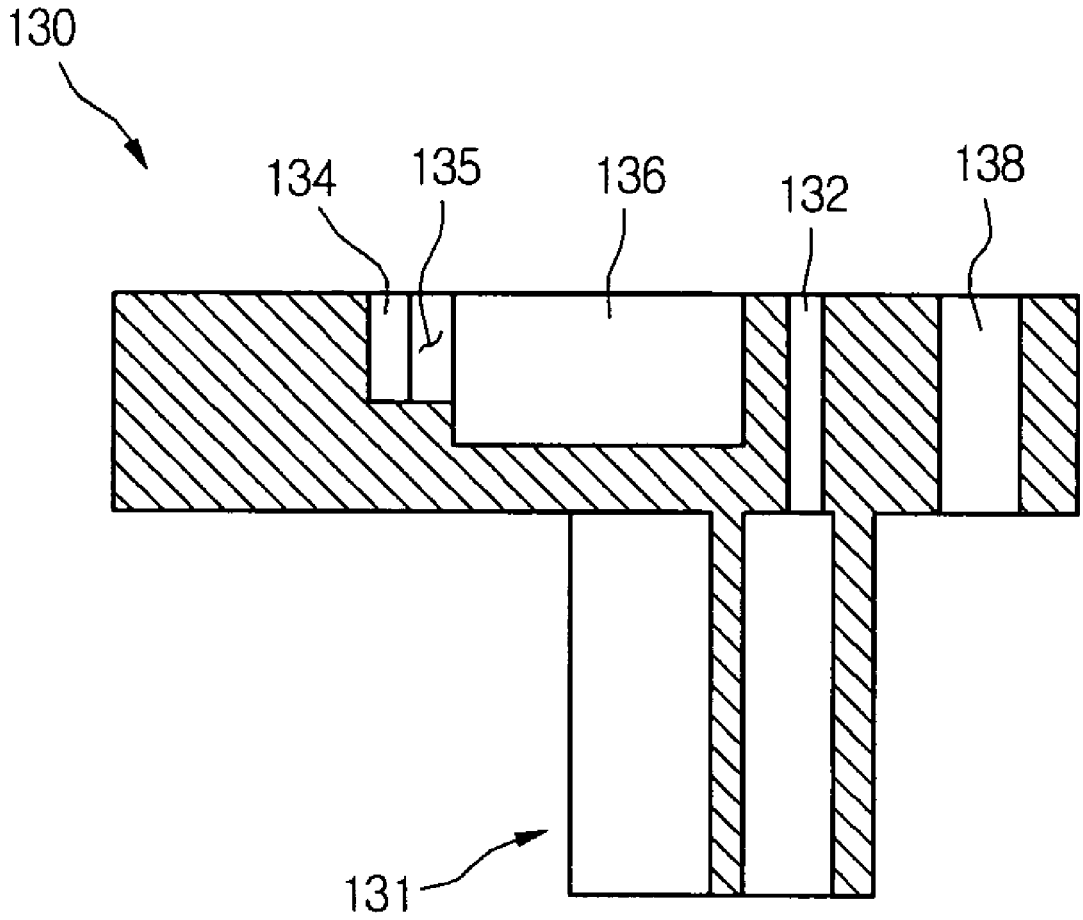
FIG. 7 is a diagram showing a cross-sectional view taken along section line I-I' in FIG. 6.

FIG. 6 shows one type of pump cover that may be used with the oil pump, and FIG. 7 shows a cross-sectional view taken along Section line I-I' in FIG. 6. Referring to FIGS. 6 and 7, a plurality of assembly holes 138, through which the assembly member 160 passes, are formed on pump cover 130. The distances between the holes 138 may be different for pump cover 130 to be directionally assembled to pump body 110.

Further, an intake unit 131 for inhaling oil stored in the oil storage reservoir 12 protrudes downwardly on a lower side of the pump cover. The intake unit may have a half-rounded shape and includes an inlet 132 through which oil passes once it passes through the intake unit.

The outlet 134 discharges the oil inhaled to gear unit 120, and is formed on the opposite side of inlet 132. The outlet is depressed from the upper part downward of the pump cover 130, and is formed to be a counterpart to inlet 132. A discharge groove 135, which discharges inhaled oil to horizontal oil passage 36, is formed on outlet 134.

A drive unit insertion groove 136, which allows for insertion of gear driving unit 34, is formed between inlet 132 and outlet 134. The drive unit insertion groove 136 and outlet 134 may be staired. That is, when gear driving unit 34 is inserted into drive unit insertion groove 136, the location of discharge groove 135 and horizontal oil passage 36 are confronted, as the depression depth of outlet 134 is lower than the depression depth of the drive insertion groove 136.

Therefore, when horizontal oil passage 36 is connected to the discharge groove 135 during rotation of gear driving unit 34, oil in outlet 134 flows to horizontal oil passage 36 through discharge groove 135. Because the discharge groove 135 may be formed at a height which corresponds horizontal oil passage 36, oil in outlet 134 may be directed to flow to horizontal oil passage 36 smoothly.

Figure 8:
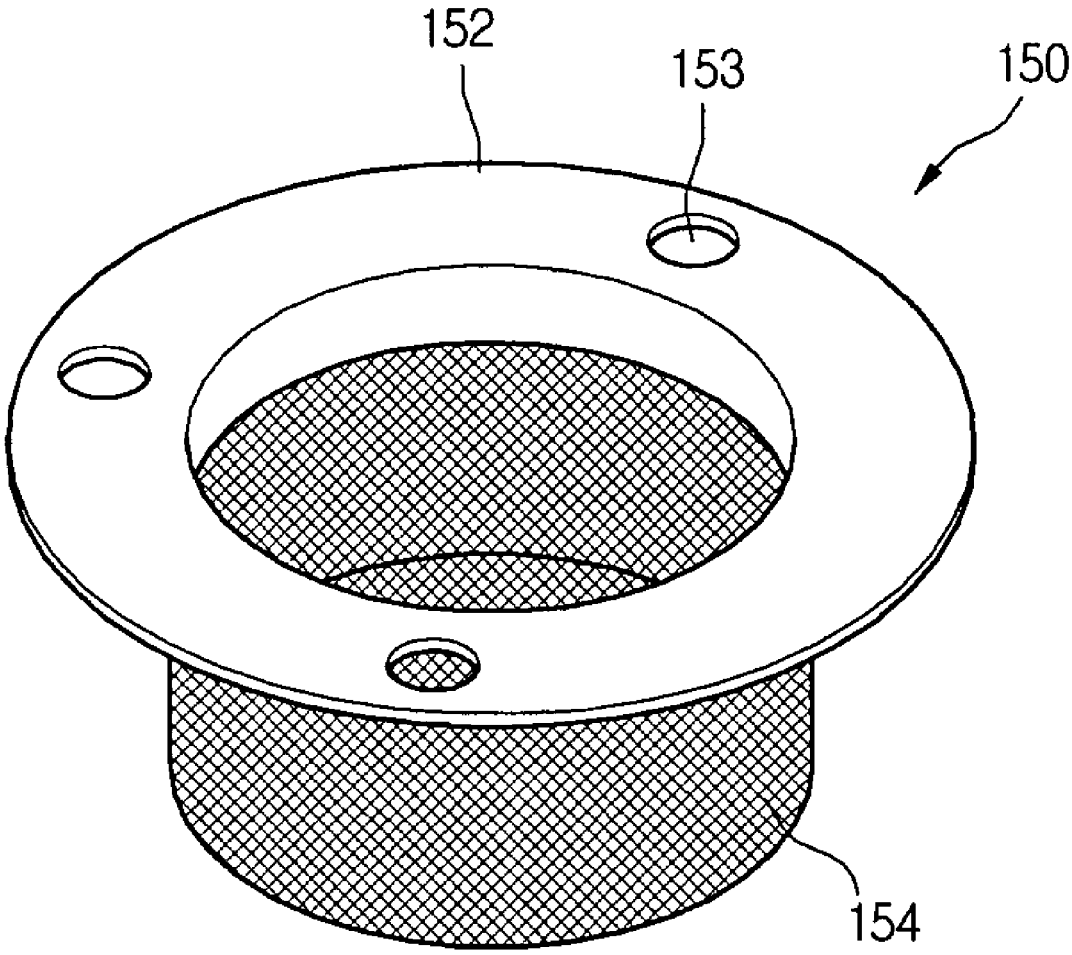
FIG. 8 is a diagram showing a perspective view of a filter member that may be included in or with the oil pump of FIG. 2.

FIG. 8 shows one embodiment of the filter member 150. According to this embodiment, the filter member includes a flange 152 assembled on a lower side of pump cover 130 and a filter unit 154 for filtering the foreign elements in the refrigerant and oil. The filter member is assembled on pump cover 130, and intake unit 131 is placed on the inner side of filter unit 154. The filter unit 154 may be formed in one body with flange 152 or assembled on a lower side of the flange.

A plurality of assembly holes 153, located where the assembly members 160 penetrate, may be formed on flange 152. The assembly holes 153 are formed at a location which confronts the location of assembly holes 138 formed on pump cover 130. Filter member 150 may be assembled on pump body 110 with the pump cover by single assembly member 160. As a result, inhalation of foreign elements to the gear unit 120 and oil passages 32, 36 is prevented, because the foreign elements in the refrigerant and oil are removed by filter member 150. The pumping operation of the gear unit 120 is therefore substantially improved.

In a process for assembling oil pump 100, first, friction reducing plate 140 is inserted into the driving shaft insertion groove 112 of the pump body. Then, the friction reducing plate is placed on plate location part 114 and the location is fixed as fixing unit is inserted into fixing hole 115.

Next, driving shaft 30 is inserted into the driving shaft insertion groove 112, and gear unit 120 is inserted into the gear insertion groove 118. The order of assembly of the drive shaft and gear unit is not fixed.

Further, the driving shaft and gear unit may be assembled under a condition where the gear driving unit 34 and the drive unit assembly hole 126 of inner gear 124 are arranged for the gear driving unit 34 being assembled on the inner gear 124.

After arranging pump cover 130 and filter member 150 on a lower side of the pump body and assembling them with single assemblage member 160, the assembly of the oil pump 100 is completed.

Figure 9:
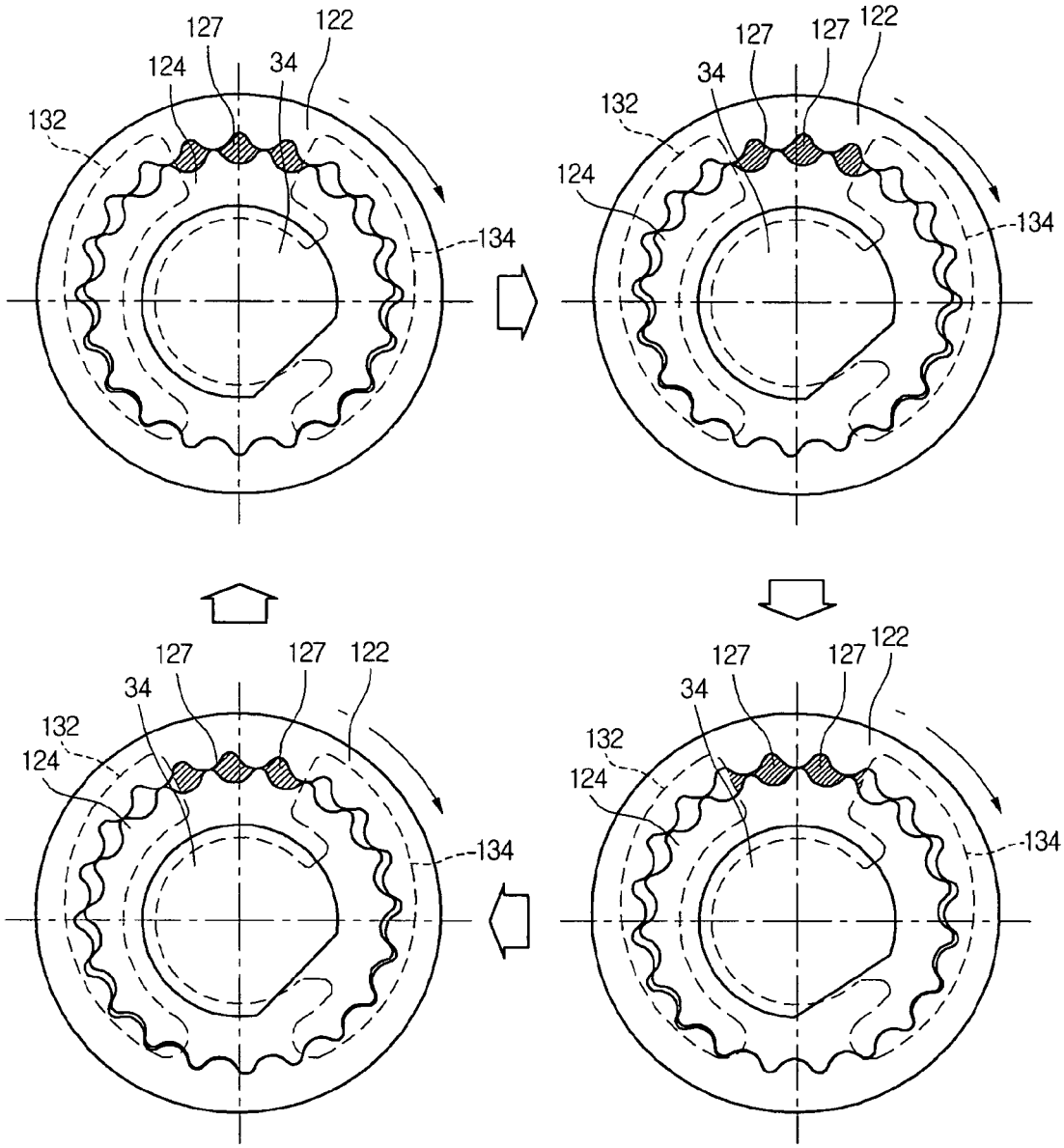
FIG. 9 is a plan illustrating one embodiment of an oil pumping process that may be performed using the gear unit of FIG. 5.

FIG. 9 shows one embodiment of an oil pumping process in the gear unit. First, the refrigerant and oil, which have been filtered to remove foreign elements by filter member 150, flows in through inlet 132 when driving shaft 30 is rotated by motor 20. The oil then flows through one or more of the chambers 127 formed between inner gear 124 and outer gear 122.

Next, inner gear 124 and outer gear 122 are rotated by the driving shaft. Particularly, gear teeth 125 of the inner gear rotate in gear with the gear teeth 123 of the outer gear 122, when the inner gear assembled on the gear driving unit rotates with the gear driving unit. The outer gear rotates by rotation of the inner gear 124.

When the gear unit rotates, oil and a refrigerant in chambers 127 are moved toward outlet 134. After the oil passes through outlet 134, the oil is discharged into horizontal oil passage 36 when discharge groove 135 and the horizontal oil passage are connected. The oil that flows to the horizontal oil passage ascends through oil passage 32 and is supplied to the friction part to be lubricated.

The oil pump of the scroll compressor according to the aforementioned embodiments is therefore able to supply oil stably. The oil pump is able to achieve this level of performance by preventing irregular supply of oil as a result of changes in the inhalation pressure. The oil pump is also able to prevent evaporation of liquid refrigerant as the chambers are formed on the gear unit.

Further, friction heat, which causes evaporation of the liquid refrigerant, is reduced as a result of the friction reducing plate placed on the pump body. This plate reduces the friction between the driving shaft and pump body.

Further, the oil moving through the driving shaft flows smoothly, as a result of a guide groove on the gear driving unit that is formed on a lower part of the driving shaft and as a result of the horizontal oil passage formed on the gear driving unit and the discharge groove of the pump cover. Furthermore, during the oil pumping operation, foreign elements in the oil and refrigerant are removed during the inhalation.

Descriptions of scroll compressors and the operation thereof may be found, for example, in U.S. Pat. Nos. 6,695,600, 6,685,441, 6,659,735, and 6,287,099, the contents of which are incorporated herein by reference and which are subject to an obligation of assignment to the same entity.

Although the embodiments described herein relate to scroll compressors for ease of discussion, it is understood that an oil pump as embodied and broadly described herein may be applied to other types of compressors and/or other applications which require fluid pumping. These other types of compressors include but are not limited to different types of scroll compressors, reciprocating compressors, centrifugal compressors, and vane-type compressors.

Figure 10:
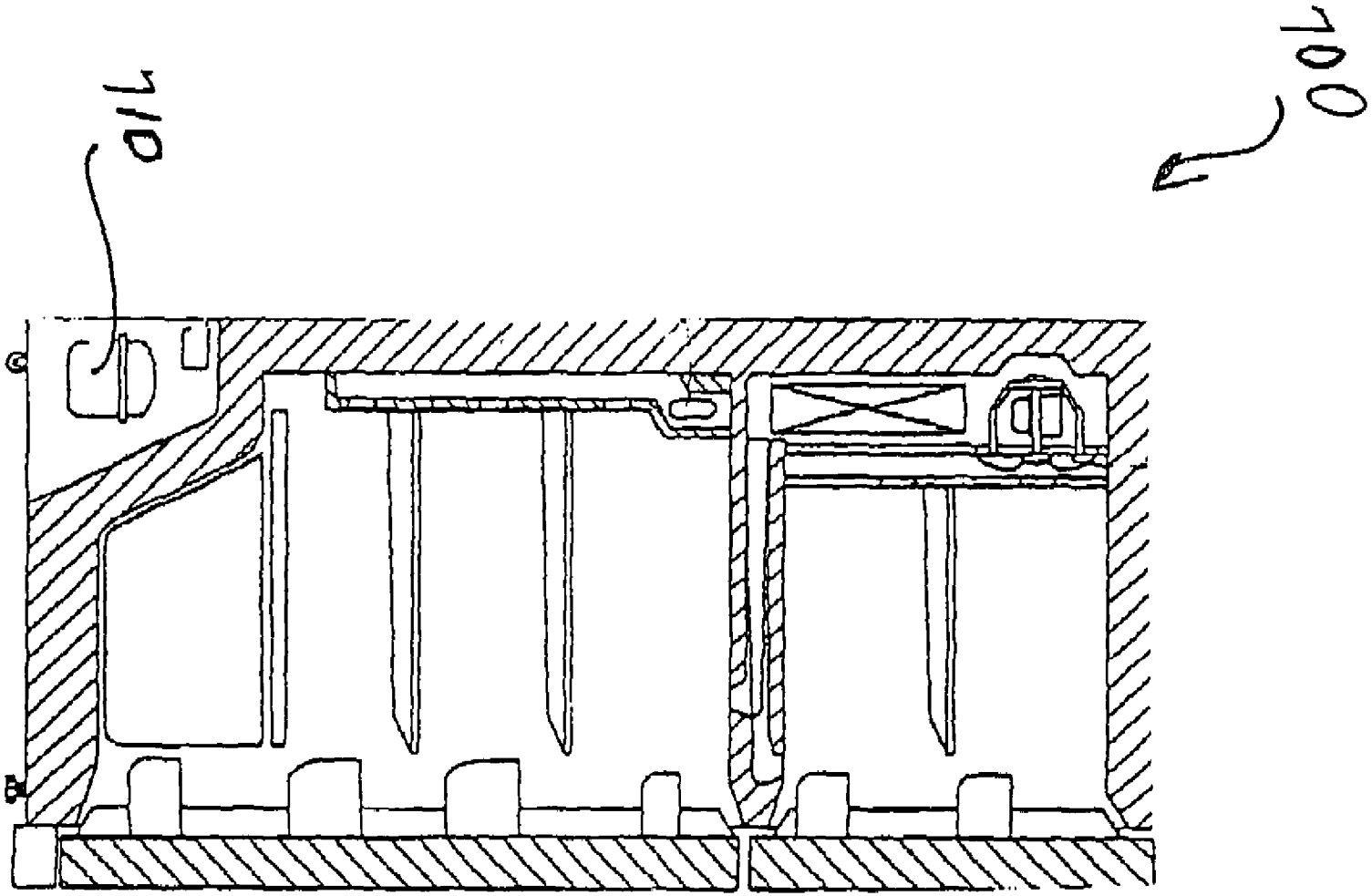
FIGS. 10-12 are exemplary installations of a compressor incorporating an oil pumping assembly as embodied and broadly described herein.

Moreover, a compressor containing the oil pump described herein may have numerous applications in which compression of fluids is required. Such applications may include, for example, air conditioning or refrigeration applications. One such exemplary application is shown in FIG. 10, in which a compressor 710 having an oil pump as described herein is installed in a refrigerator/freezer 700. The installation and functionality of a compressor when embodied within a refrigerator is discussed in detail in U.S. Pat. Nos. 7,082,776, 6,955,064, 7,114,345, 7,055,338, and 6,772,601, the entirety of which are incorporated herein by reference.

Figure 11:
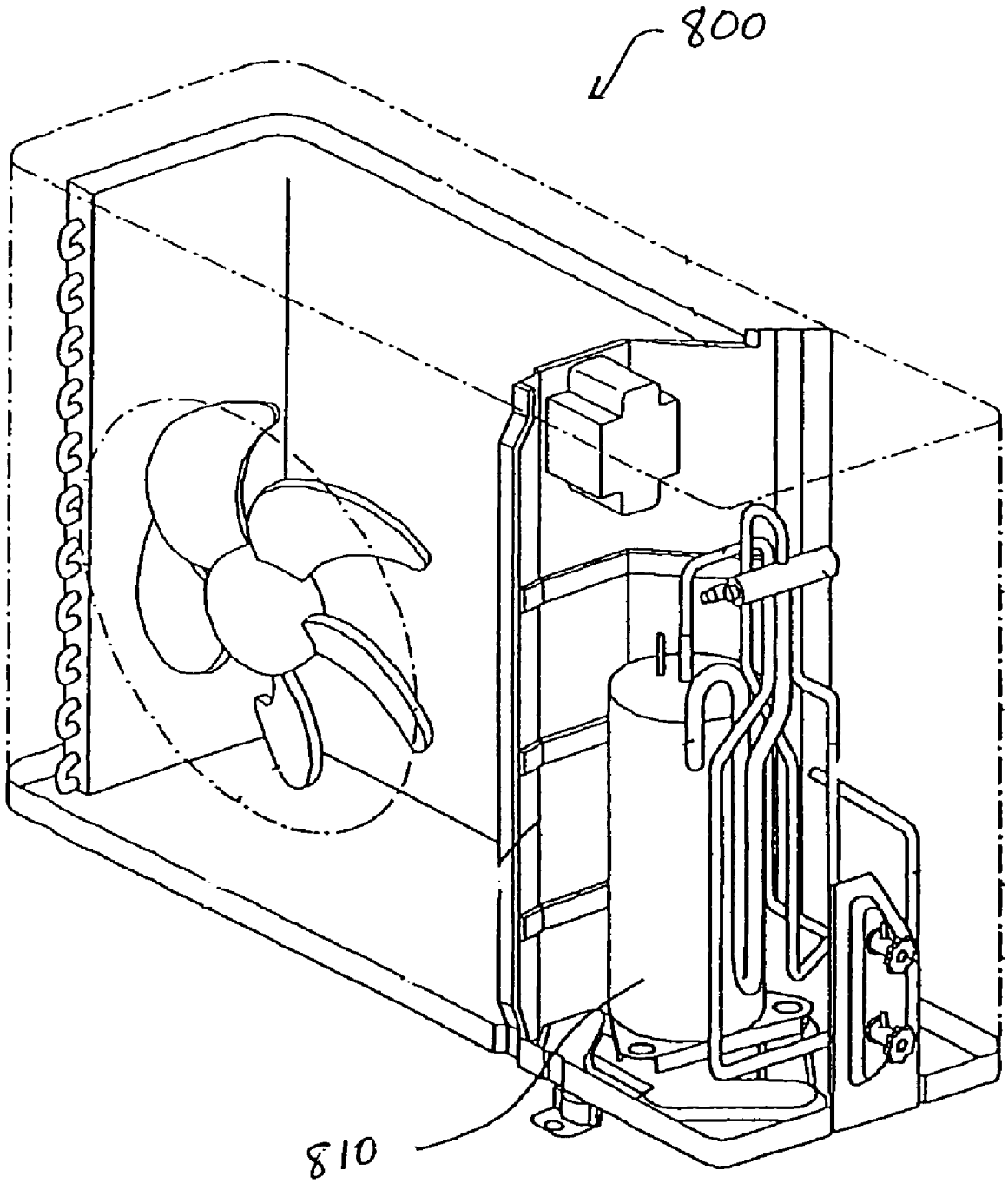
Figure 12:
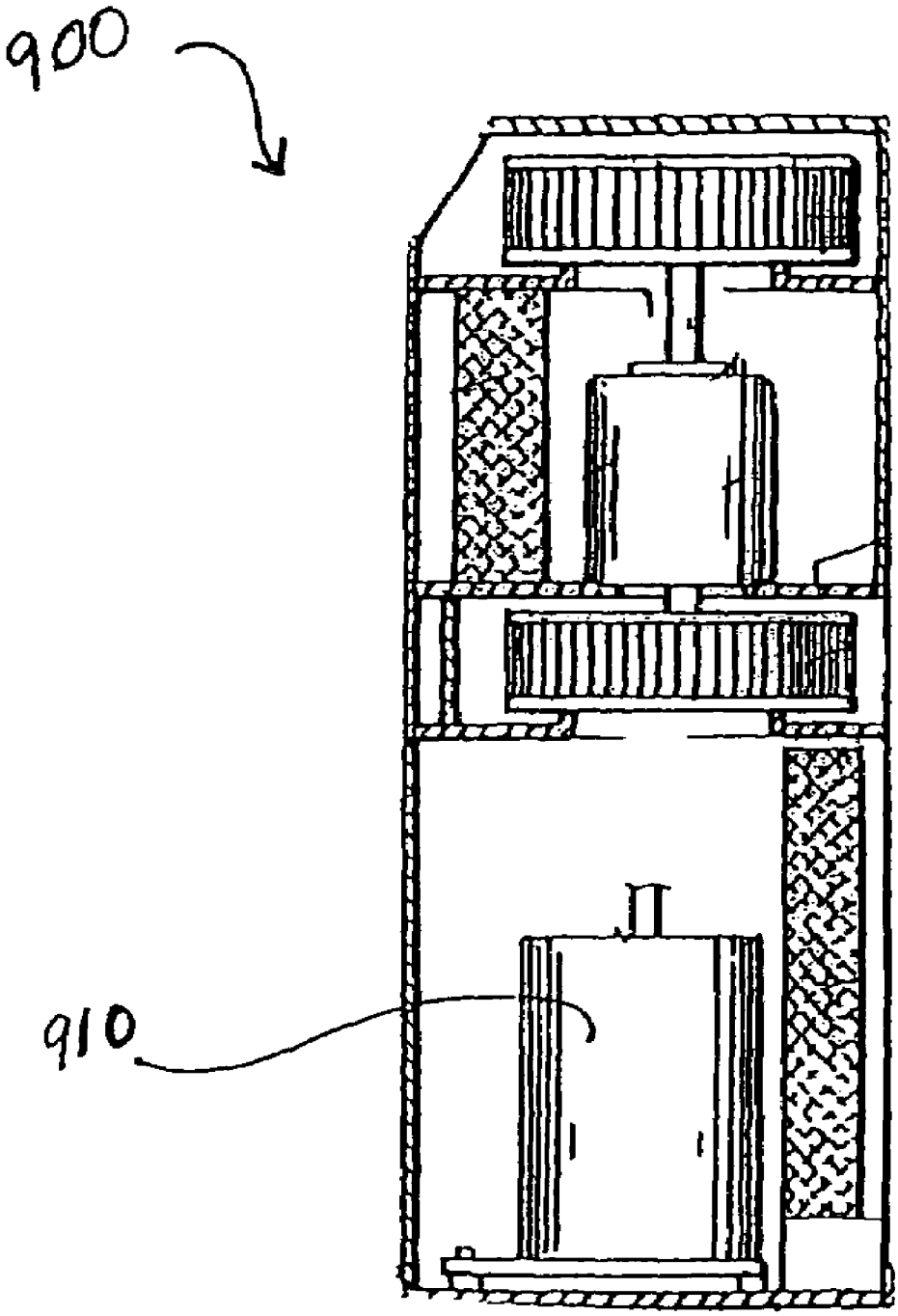

Another exemplary application is shown in FIG. 11, in which a compressor 810 having an oil pumping assembly as described herein is installed in an outdoor unit of an air conditioner 800. The installation and functionality of a compressor when embodied within an outdoor unit of air conditioner is discussed in detail in U.S. Pat. Nos. 7,121,106, 6,868,681, 5,775,120, 6,374,492, 6,962,058, 6,951,628, and 5,947,373, the entirety of which are incorporated herein by reference.

Another application of the compressor containing an oil pump as described herein relates to an integrated air conditioning unit. As shown in FIG. 9, this application includes a compressor 910 having an oil pump as described herein is installed in a single, integrated air conditioning unit 900. The installation and functionality of a compressor when embodied within an outdoor unit of air conditioner is discussed in detail in U.S. Pat. Nos. 7,036,331, 7,032,404, 6,588,228, 6,412,298, 6,182,460, and 5,775,123, the entirety of which are incorporated herein by reference.

According to another embodiment, the oil pump of the scroll compressor comprises: a driving shaft having an oil passage in the inner part and a gear driving unit on the lower part; a pump body having a driving shaft insertion groove for inserting the driving shaft; a friction reducing member placed on the driving shaft insertion groove and reducing the friction between the driving shaft and pump body; a gear unit inserted into the lower side of the pump body and rotated with the rotation of the driving shaft; and a pump cover coupled to the lower side of the pump body and having an intake for inhaling the oil.

According to another embodiment, there is provided an oil pump of the scroll compressor comprising: a pump body; a driving shaft coupled to the upper side of the pump body; a gear unit placed on the lower side of the pump body and rotated with the rotation of the driving shaft; a friction reducing member reducing the friction between the driving shaft and pump body; a pump cover assembled on the lower side of the pump body; and a filter member assembled on the lower side of the pump cover and filtering the foreign elements in the oil.

According to another embodiment, there is provided an oil pump of the scroll compressor comprising: a pump body; a driving shaft having a horizontal oil passage assembled on the upper side of the pump body and flowing the oil and a perpendicular oil passage connected to the horizontal oil passage; a friction reducing member reducing the friction between the driving shaft and the pump body; a gear unit inserted into the lower side of the pump body and rotated with the rotation of the driving shaft; a pump cover coupled to the lower side of the pump body, and having an intake inhaling the oil and an outlet discharging the oil.

It is effective that the irregular oil supplying by the changes of the inhaling pressure and evaporation of the liquid refrigerant is prevented with a plurality of oil chambers formed on the gear unit.

It is also effective that the oil is easily supplied to the friction part as the irregular oil supplying is prevented.

It is also effective that the friction heat, which causes evaporation of the liquid refrigerant is reduced as a friction reducing member is placed on the pump body and so the friction between the driving shaft and the pump body is reduced.

It is also effective that the pumping operation of the oil pump is progressed effectively as the foreign elements are filtered when the refrigerant and oil are inhaled to the oil pump.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oil pump for a scroll compressor, comprising:

a driving shaft having an oil passage formed therein;

a gear driving unit coupled to the driving shaft;

a pump body having a driving shaft insertion groove formed at an upper side thereof;

a friction reducing member inserted in and seated on a bottom of the driving shaft insertion groove so as to reduce friction between the driving shaft and pump body;

a gear unit coupled to the pump body so as to rotate together with the driving shaft; and a pump cover coupled to the pump body and having an intake that draws in oil.

2. The oil pump of claim 1, further comprising:

a filter member that filters foreign elements from the oil drawn in through the intake, said filter member being positioned on a lower side of the pump cover.

3. The oil pump of claim 2, wherein the filter member has a plurality of assemblage holes through which an assemblage member penetrates, and a distance between the holes are different from each other.

4. The oil pump of claim 1, wherein the friction reducing member has a drive unit penetrating hole through which the drive unit penetrates.

5. The oil pump of claim 1, wherein the friction reducing member has a protruding fixing unit that fixes the fiction reducing member on the pump body, and wherein the pump body has a fixing hole into which the protruding fixing unit is inserted.

6. The oil pump of claim 1, wherein an outer diameter of the gear driving unit is smaller than that of the driving shaft.

7. The oil pump of claim 1, wherein a driving surface for rotating of the gear unit is formed on the gear driving unit.

8. The oil pump of claim 1, further comprising:

a guide groove for smoothly drawing in oil formed on a circumferential surface of the gear driving unit.

9. The oil pump of claim 1, wherein the oil passage includes a first oil passage, and a second oil passage formed perpendicular to and connected to the first oil passage.

10. The oil pump of claim 9, wherein the pump cover has an outlet for discharging the oil, drawn in through the intake, to the gear unit, wherein the outlet is positioned at a height corresponding to the first oil passage when the gear driving unit is mounted on the pump cover.

11. The oil pump of claim 1, wherein the gear unit includes an outer gear having gear teeth formed on an inner circumferential surface thereof, and an inner gear having gear teeth formed on an outer circumferential surface thereof and coupled to the outer gear.

12. The oil pump of claim 11, wherein a plurality of chambers for accommodating the oil are formed between the inner gear and the outer gear.

13. An oil pump for a scroll compressor, comprising:

a pump body;

a driving shaft coupled to the pump body;

a gear unit installed on the pump body so as to rotate together with the driving shaft;

a friction reducing member that reduces friction between the driving shaft and the pump body;

a pump cover coupled to the pump body, wherein the pump cover covers the gear unit and includes an intake; and a filter member coupled to the pump cover and covering the intake so as to filter foreign elements from oil flowing therethrough.

14. The oil pump of claim 13, wherein the pump cover and filter member are coupled on the pump body by a single assembly member.

15. The oil pump of claim 13, further comprising:

a fixing unit formed on the friction reducing member, and fixing holes formed on the pump body so as to receive the fixing unit therein.

16. The oil pump of claim 13, wherein a driving shaft insertion groove is formed on the pump body and a gear insertion groove that receives the gear unit is formed on the pump body, and a driving shaft penetrating hole is formed between the driving shaft insertion groove and the gear insertion groove.

17. The oil pump of claim 13, wherein a gear driving unit coupled to the gear unit is formed integrally on the driving shaft, and wherein a diameter of the gear driving unit is less than a diameter of the driving shaft.

18. The oil pump of claim 13, wherein the gear unit includes an outer gear having gear teeth formed on an inner circumferential surface thereof, and an inner gear having gear teeth formed on an outer circumferential surface thereof, wherein the inner gear is inserted into the outer gear.

19. The oil pump of claim 13, wherein the driving shaft includes a first oil passage that draws in oil and a second oil passage connected to the first oil passage that transfers oil drawn in through the first oil passage.

20. An oil pump for a scroll compressor, comprising:

a pump body;

a driving shaft coupled to the pump body, and having a gear driving unit including a horizontal first oil passage that draws in oil and a second oil passage coupled to the first oil passage;

a friction reducing member that reduces friction between the driving shaft and pump body;

a gear unit installed on the pump body so as to rotate together with the driving shaft; and a pump cover coupled to the pump body and having an intake that draws in oil and an outlet that discharges oil, wherein at least a portion of the gear driving unit is inserted into the pump cover such that when the horizontal first oil passage is aligned with the outlet, oil flows from the outlet into the horizontal first oil passage.

* * * * *